US007411120B2

(12) United States Patent
Dai et al.

(10) Patent No.: US 7,411,120 B2
(45) Date of Patent: Aug. 12, 2008

(54) STRINGED INSTRUMENT WITH OFFSET STRUCTURE

(76) Inventors: Chung-Ji Dai, 4780 S. Fortuna Way, Salt Lake City, UT (US) 84124; Chung-Chu Dai, 4780 S. Fortuna Way, Salt Lake City, UT (US) 84124

( * ) Notice: Subject to any disclaimer, the term of this patent is extended or adjusted under 35 U.S.C. 154(b) by 30 days.

(21) Appl. No.: 11/155,948

(22) Filed: Jun. 16, 2005

(65) Prior Publication Data

US 2006/0283306 A1 Dec. 21, 2006

(51) Int. Cl.
*G10D 1/02* (2006.01)

(52) U.S. Cl. ..... 84/274

(58) Field of Classification Search ..... 84/274, 84/275, 291, 292, 293, 307, 309, 314 R
See application file for complete search history.

(56) References Cited

U.S. PATENT DOCUMENTS 858,587 A * 7/1907 Ehlenz ..... 84/275
863,246 A * 8/1907 Wood ..... 84/274
1,303,466 A * 5/1919 Dunham ..... 84/275

* cited by examiner

*Primary Examiner*—Ross N Gushi
(74) *Attorney, Agent, or Firm*—Thorpe North & Western LLP

(57) ABSTRACT

An orchestral string instrument, comprising a resonant chamber and housing defined by a back member, curved sides and a front member having a pair of f holes positioned on opposing sides of a bridge support location on the front. The housing also includes a sound peg disposed between the front and back and a central axis extending between the f holes from an upper end of the housing to an opposing lower end. A fingerboard and neck are attached to the upper end of the housing and include a longitudinal central axis in a laterally offset position from the central axis of the housing. A nut is provided for supporting strings of the instrument above the fingerboard, wherein the nut is coupled to a distal end of the fingerboard and neck. A tail piece is attached to a lower end of the housing in a comparable offset position with the offset position of the fingerboard and neck, the tail piece being configured for supporting lower ends of the strings. Finally, a scroll with string pegs laterally positioned in sides of the scroll for adjustably supporting upper ends of the strings is attached to the nut in alignment with the fingerboard.

19 Claims, 2 Drawing Sheets

STRINGED INSTRUMENT WITH OFFSET STRUCTURE

BACKGROUND OF THE INVENTION

1. Field of the Invention

The present invention relates generally to orchestral string instruments such as violins, violas, cellos and basses. More particularly, the present invention relates to a reduced size viola.

2. Related Art

The evolution of ensemble and orchestral music was significantly advanced with development of stringed instruments (violin, viola, cello and bass) that were collectively voiced to provide a full range of audio experience to the listener. FIG. 1 shows a traditional viola configuration 10, representing the basic components of the family of orchestral strings. Typically, these instruments have four strings 12, 14, 16, and 18 that are tuned at four sequential intervals separated by a musical fifth scale of notes. The four strings enable the player to play a continuous scale of notes by progressively depressing the strings against the fingerboard 20 at appropriate intervals. An upper harmonic range also exists where the strings of the instrument are not fully depressed against the fingerboard, but are merely touched by a finger to impose a stationary node along the string's length. By using a combination of depressed and harmonic tones, the string player can perform a very broad range of pitches with varying tone qualities on any one of the various stringed instruments.

The principle components of a typical orchestral stringed instrument include a scroll 22 that provides support for tuning pegs 24 coupled to each of the four strings. A nut 26 positions the strings above the fingerboard 20, which provides the fingering surface of the instrument. The fingerboard is supported by an elongate neck member 30 that is attached to the body 32 of the instrument. This body provides a resonant chamber for amplifying tones generated by plucking or bowing the strings. The body includes front 34 and back 35 members and sides 36 that collectively define the sound chamber. The sides include an upper bout 37, a lower bout 38 and an intermediate C-bout 39. A bridge 40 correctly positions the strings above the fingerboard and is located near f holes 42 and 44 which assist in projecting the sound beyond the instrument. The bridge is supported by a sound peg (not shown) positioned within the chamber below the bridge and between the front and back members. The strings connect to a tail piece 46, which in turn is coupled to a bottom end 48 of the instrument body.

As shown in FIG. 1, these components are classically configured symmetrically on opposite sides of a central axis 50 of the instrument. Specifically, the fingerboard, front and back, sides, f holes, tail piece and strings are spaced equally on opposite sides of the central axis in a substantial mirror image. This symmetry has been perpetuated for many centuries, preserving a classical shape that is well recognized by the public. More significantly, string players have become accustomed to this classic configuration and are generally inclined to expect stringed instruments to comply in shape with this expectation.

Aside from use as solo instruments and in chamber ensembles, these stringed instruments are most commonly found in the string section of an orchestra. The lowest audio frequencies within the string section of the orchestra are developed by the string bass, with low pitches extending down to a low E, almost three octaves below middle C (440 cps). To achieve such low tones, large diameter strings are used having a vibrating length of approximately 46 inches.

This vibrating length is the distance between (i) the lower, supporting bridge positioned on the face of the instrument and (ii) the upper nut located at the upper end of the fingerboard. The nut and bridge serve to elevate the strings in close proximity above the fingerboard to allow the player to comfortably depress the string into contact with the fingerboard, thereby changing the associated pitch by the vibrating length measured between the bridge and the depressed position.

The upper range of the bass instrument generally extends into the several octaves below middle C. This upper range overlaps with the lower pitch range of the cello, which is the next instrument in the quartet of stringed instruments of the orchestra. The cello strings are tuned to C, G, D and A at separated fifth intervals immediately below middle C. The open string vibrating length is approximately 26½ inches. Accordingly, the space between notes of the scale on the cello is a shorter distance than on the bass. The pitch range of the cello extends approximately the same as the human voice, and much higher when including harmonic tones. The larger size of the bass and cello requires that the player address the instrument in an upright position, with the performer in a standing or seated position, The hand and fingers of the player are applied to the fingerboard from one side of the instrument, while the bowing hand approaches the strings from an opposite side of the instrument, moving the bow across one or more strings between the bridge and the fingerboard.

The upper strings of the string family are the viola and violin. The viola has a open string length of approximately 14¼ inches, slightly more than half the length of the cello and has a voice range that starts at C below middle C, and extends up through the sequential pitches of G, D and A respectively one octave above the cello strings. The vibrating string length of the violin is slightly shorter at approximately 13 inches, with the low string tuned to G above middle C. The three upper strings extend through the range of fifth intervals from D, A and E. The body of the violin is significantly smaller in volume than the viola and consequently has a higher, usually thinner sound quality.

The beauty of the viola, particularly within the blend of the orchestra, is its deeper, rich tone quality. Naturally, this is partially the result of the larger volume within the housing or resonant chamber of the instrument. Both the violin and viola are played in a raised, horizontal position, with the lower part of the instrument captured between the shoulder and chin of the player. Both the fingering hand and the bow hand are applied to the strings from the same side of the instrument, in contrast to the bass and cello.

Because of the similar size of the viola and violin, violinists are often requested and/or inclined to play the viola. For example, viola players are fewer in number than violinists and may be recruited from a more numerous violin section of the orchestra. Although technique is approximately the same, the greater length of the viola requires a noticeably larger spacing fingering positions than on the violin. This larger size also imposes an unnatural extension of the fingering hand and arm for a violinist. This awkward position can cause tendonitis, carpel tunnel syndrome or other maladies with continuous playing. Furthermore, it makes interchange of the instruments more difficult because of the required adjustments in hand position for the longer viola. In other words, when a violinist plays a viola, the intricate fingering movements of the performer must not only be adjusted to a slightly wider pitch interval due to longer string lengths, but the player must make these adjustments at a displaced hand distance from his body that extends beyond his violin position by an additional inch or two. This additional distance mandates changes in position for the shoulder, elbow and wrist, as well as fingers.

In view of the enumerated challenges attendant to interchanging use between the violin and viola, some attempts have been made to reduce viola size. Typically, however, a reduction in viola length has resulted in loss of rich tone quality. It has been found, for example, that merely reducing the length of the fingerboard and neck on the viola seriously affects the quality of the rich viola sound. Similarly, reducing the size and length of the viola body compromises the deeper tone quality of the viola. Accordingly, the traditional size differences of the violin and viola have been maintained down through the centuries, requiring violinists to manage the limitations of interchanging performance with both violin and viola as best they can.

SUMMARY OF THE INVENTION

It has been recognized that it would be advantageous to develop a stringed instrument that can have a reduced size without sacrificing deeper tone quality that traditionally arises from the larger body of the instrument. The present invention provides a reduction in size without commensurate loss of tone quality. This is provided in connection with a string instrument comprising a resonant chamber and housing defined by a back, curved sides and a front, said housing having a central axis extending between an upper end of the housing to an opposing lower end. A fingerboard and neck are attached to the upper end of the housing in an offset position from the central axis of the housing. A nut is provided for supporting strings of the instrument above the fingerboard, the nut being coupled to a distal end of the fingerboard and neck. A tail piece is attached to a lower end of the housing in a comparable offset position with the offset position of the fingerboard and neck, the tail piece being configured for supporting lower ends of the strings.

Additional features and advantages of the invention will be apparent from the detailed description which follows, taken in conjunction with the accompanying drawings, which together illustrate, by way of example, features of the invention.

DETAILED DESCRIPTION

Figure 1:
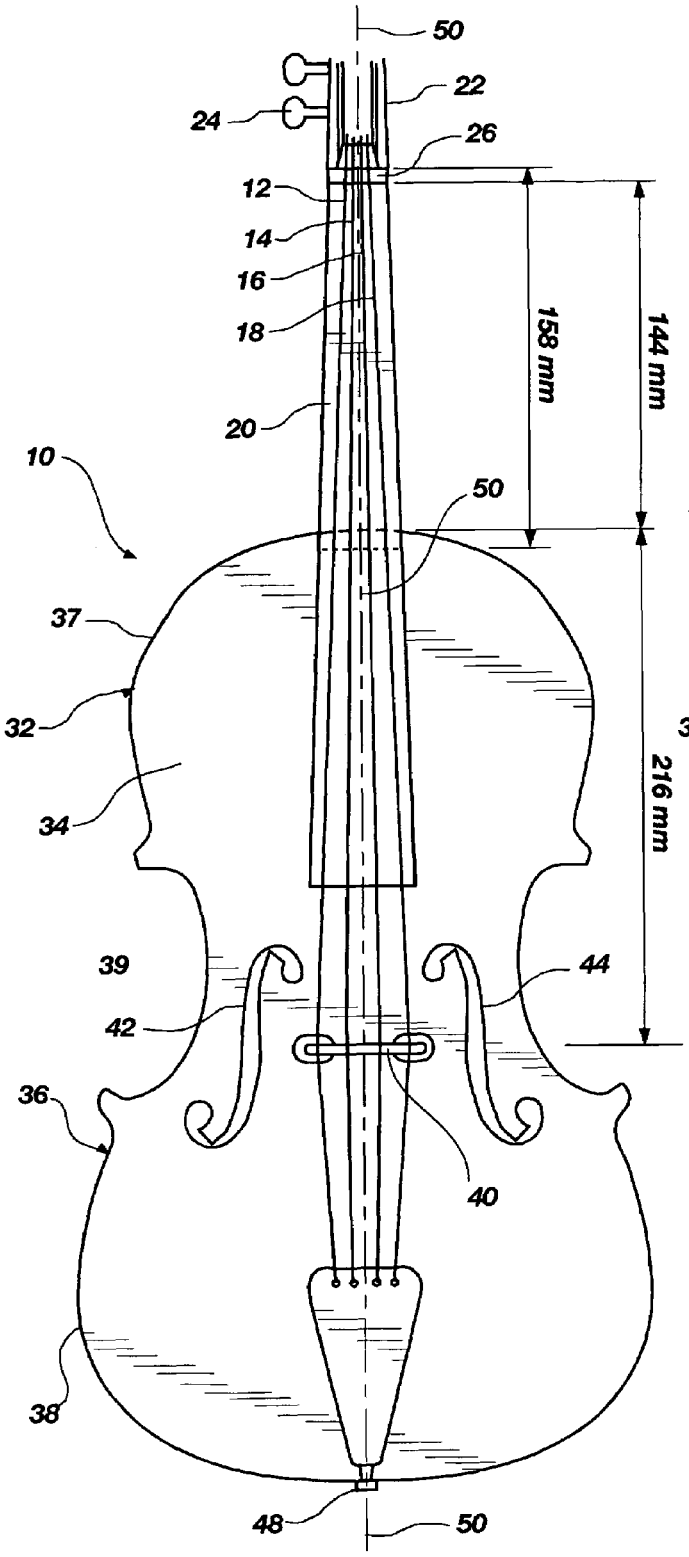
FIG. 1 is a front, plan view of a traditional viola, labeled as prior art.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
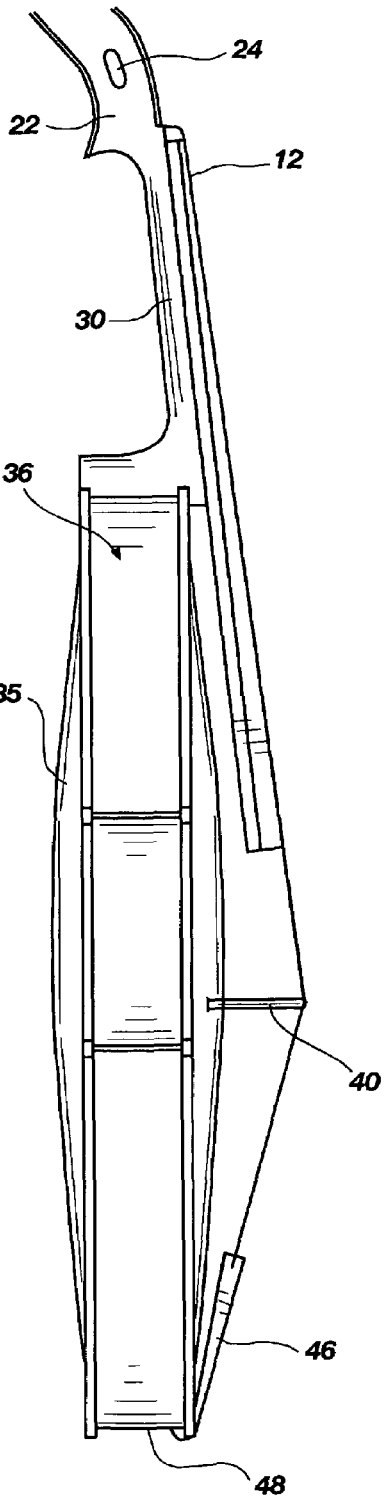
FIG. 2 shows a front, plan view of a viola having a modified configuration in accordance with one embodiment of the present invention.

A preferred embodiment of the present invention comprises an orchestral string instrument 100 having a resonant chamber and housing 110 defined by a back member 135, curved sides 132 and a front member 134. A pair of f holes 142 and 144 are centrally positioned on opposing sides of the front. A sound peg (not shown) is disposed between the front and back to provide support in response to forces arising from string tension applied at the front of the instrument through the bridge 140. The relative position of the fingerboard 120, strings 124 and bridge 140 with the body of the instrument, as well as the configuration of the housing, can be modified into a nonsymmetrical form and thereby reduce the length of the instrument without seriously affecting the quality of sound. Specifically, the viola of FIG. 2 has been reduced in the open string length by approximately ¾ inch, from 14 3/16 inches to 13 5/16 inches. This enables a violin player to use a viola without encountering many of the limitations arising when using a classic viola shape.

Figure 3:
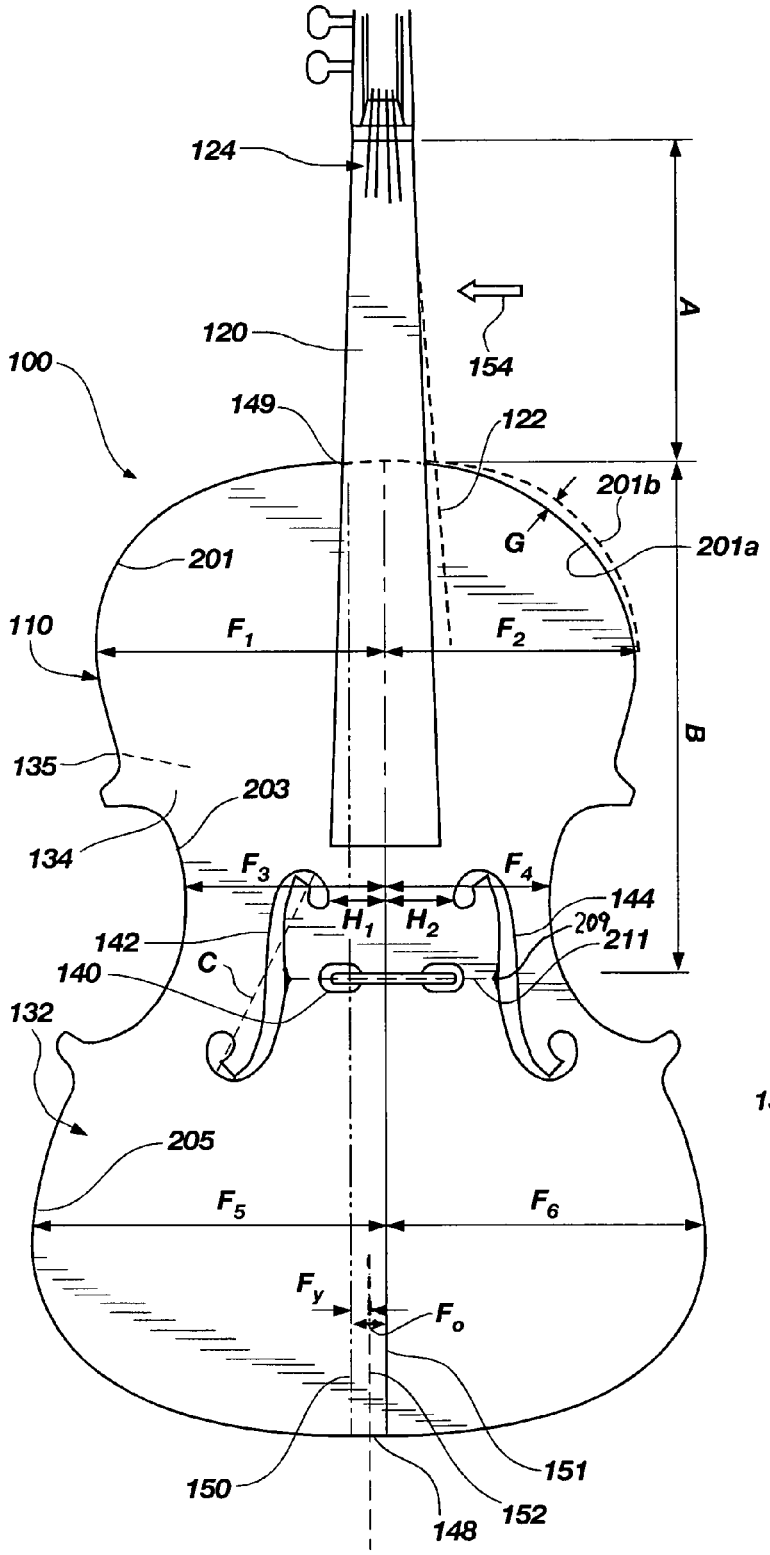
FIG. 3 depicts a plan, side view of the viola shown in FIG. 2.
Figure 4:
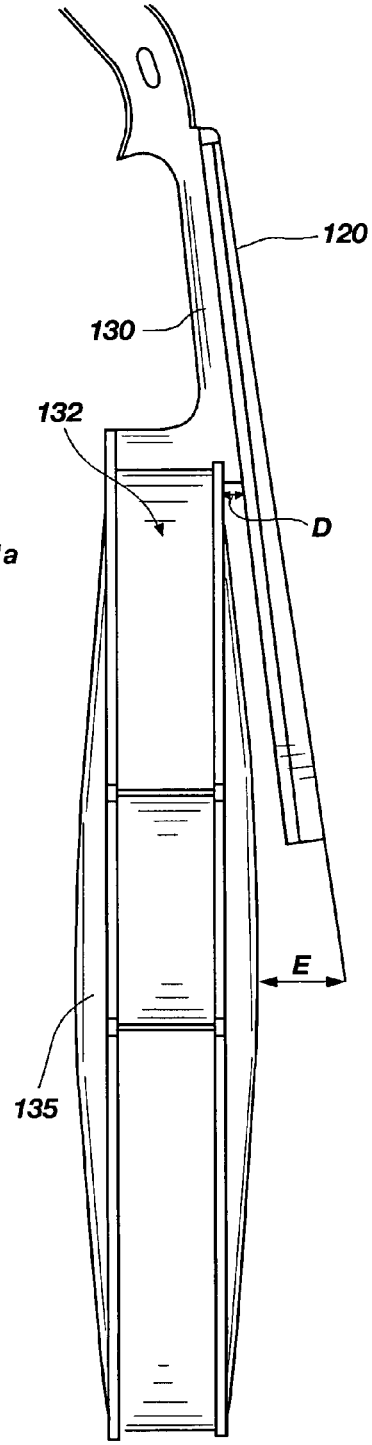
FIG. 4 shows an overlay representation between the prior art viola of FIG. 1 and the embodiment of FIG. 2 illustrating differing dimensions.

Specifically, the present inventors have discovered an unexpected phenomenon in enhanced sound with modifications of the symmetrical configuration of classical string instruments, particularly when applied to the viola. As shown in FIG. 1, the respective central axes of the fingerboard and the housing are coincident, the two axes dividing the instrument down the middle with mirror image structures on each side. In the structurally modified version of FIG. 3, this original axis (now designated as 150) is no longer coincident with either the longitudinal central axis 151 of the fingerboard or the new longitudinal central axis 152 of the housing. Indeed, one of the modifications discovered with the instant invention is to position the central axis 151 of the fingerboard laterally offset from the central axis 152 of the housing. This offset location still extends between the f holes from an upper end 149 of the housing to an opposing lower end 148; however, the opposing sides of the housing are now asymmetrical with respect to the fingerboard.

From another perspective, the fingerboard 120 and neck 130 are attached to the upper end 149 of the housing in a laterally offset position with respect to the central axis 152 of the housing. The effect of this displacement may be used to place the fingerboard and playing positions of the hand closer to the performer, thereby simulating the smaller size of the violin. For example, the configuration of FIG. 2 for a right handed musician provides for fingerboard and bow access from the right side of the drawing at arrow 154. Accordingly, there is less width of the body of the instrument for the performer to reach across, thereby giving closer proximity to the strings. For a left handed artist, the fingerboard displacement would be to the opposite side of the viola, giving closer access for the right hand on the fingerboard.

It should be noted that the fingerboard 120 and neck 130 may still extend substantially parallel with the central axis 152 of the housing, as with classic configuration of FIG. 1. Other orientations of the fingerboard may be useful, however, where a slight inclination 122 may be present with respect to the housing central axis 152. Such offset inclination can be suited to a particular orientation of interest to the instrumentalist. Generally, however, a classical configuration where the fingerboard and neck are parallel with the central axis of the housing will be preferred.

Specific dimensions for the offset position will be determined based on the final dimensions of the instrument, and in particular the size and configuration of the housing. However, a preferred range for the offset $F_y$ of the fingerboard laterally from the central axis 152 of the housing as shown in the drawings is within a range of 2.5 mm to 20 mm. This equates to a displacement $F_o$ of the fingerboard axis 151 from the classic central axis 150 of 5 mm to 40 mm, equal to the width of the offset on each side of the new fingerboard axis 151. For the 15½ inch embodiment of the viola, that offset position $F_y$ is within a range of approximately 1.5 mm to 10 mm, and specifically a preferred value of 3.5 mm.

Other dimensions that apply to the present invention include a range of lengths for the reduced size viola. Typically, the length of an instrument is a function of the size and/or age of the performer. For example, violins are graduated at sizes of $1/16^{th}$, $1/8^{th}$, $1/4^{th}$, ½, $3/4^{th}$, and full size to allow smaller children to advance through increasing sizes of instruments as they grow. Although the modifications disclosed herein may be applied to these smaller sizes of viola, the following discussion generally applies to full size instruments. A total open string length of the instrument within a full size modified viola for the present invention ranges from approximately 13 inches to 14 inches. A preferred dimension of length is approximately 13½ inches.

An additional dimension of interest in this invention is the distance from the central axis of the fingerboard 151 to the extreme edge of the bouts or curved sides of the instrument. There are three bouts of interest, the upper bout 201, the C bout 203 with its C-shaped curvature, and the lower bout 205 with its longer dimension. This length is measured along a normal or perpendicular orientation from a center line or axis along the fingerboard in an upper half of the housing to the upper bout 201. This length is approximately 106 mm to 130 mm and to an opposing side of the instrument is within a corresponding range of 94 mm to 102 mm. Selection of a shorter value of the range on one side would suggest a corresponding selection of values within the shorter range of values on the opposing side. Normally, these selections would be proportional in relationship. For example, a first value is selected at 108.4 (10% of the range from 106 mm), then the shorter opposing side would be approximately 95.2 mm (a corresponding 10% of the range from 94 mm). With respect to the preferred body length of instrument at 15½ inches, the maximum length along the normal orientation from the center line along the fingerboard to the upper bout is approximately 111 mm and to the opposing side of the instrument is 96 mm.

With respect to the distance to the C bout, a maximum length along a normal orientation from a center line along the fingerboard in this central, narrowest portion of the housing is approximately 71 mm to 86 mm and to an opposing side of the instrument is 63 mm to 71 mm. The same proportional relationship would apply with these and similar length ranges for other parts of the instrument. For the 15½ inch embodiment, the maximum length along the normal orientation from the center line along the fingerboard to the central, narrowest portion of the housing at the C bout is approximately 76 mm and to the opposing side of the instrument is 55 mm.

Similar measurements at the lower bout 205 provide a maximum length along a normal orientation from a center line along the fingerboard in a lower half of the housing to the bout at one side of the instrument of approximately 131 mm to 162 mm and to an opposing side of the instrument is 118 mm to 134 mm. Again for the preferred embodiment at 15½ inches in body length, the distance along a normal orientation from the center line along the fingerboard in the lower half of the housing to one side of the instrument is approximately 137 mm and to an opposing side of the instrument is 123 mm.

Another dimension of interest is the length of the combined neck and scroll. This length has been reduced to facilitate handling in a manner similar to a violin, having a shorter length than a conventional viola. In the present invention, the neck and scroll have a cumulative length of 100 mm to 154 mm extending from the upper end of the housing to the nut. Where the instrument open string length is about 13½ inches, the neck/scroll length is approximately 131 mm.

Positioning the f holes 142, 144 correctly is also a significant aspect of the present invention. Generally, these f holes include centrally located lateral notches 209. One method of locating the position of the f holes is to connect a line 211 between the notches between opposing f holes. For the preferred embodiment, the f holes are positioned along the housing where this connecting line intercepts the central axis of the housing at approximately 216 mm from the upper end of the housing (Length B) Length A reflects the neck length extending to the neck/scroll. The length of the f holes may be configured with a length within a range of 50 mm to 110 mm. The length c of the f holes for the preferred embodiment is approximately 92 mm.

The offset position of the f holes along the connecting line 211 may vary. The distances H, and $H_2$ of the two opposing f holes 142*a* and 144*b* from the central axis 151 are typically not equal. Specifically, a comparative distance of f hole 142*a* on one side from the central axis 151 is within a range of 0.5 to 5 mm of the distance to the f hole 144*b* on the other side of the central axis 151. As an example, the distance from f hole 14*d* may be approximately 24.5 m. The distance $H_2$ to the opposing f hole 144*b* will be within the range of 0.5 to 5 mm longer than the f hole 142. The inventors in the preferred embodiment have found this comparative distance to be approximately 1 mm. Accordingly, f hole 144 is approximately 25.5 from the central axis 151 of the fingerboard.

A further dimension of importance is the vertical length D along the neck from the front of the housing to an adjacent underside of the fingerboard. Generally, this height dimension is within a range of 3 mm to 14 mm. For the preferred length of the 15½ inch viola, this height is approximately 9.5 mm. Obviously, the string height above the fingerboard is controlled by the height of the bridge.

An interesting modification within the present invention arises with consideration of the configuration of the upper bout 201. Specifically, the curved perimeter of one side of the upper housing bout is different compared to a superimposed curved perimeter 201*b* of the other side 201 of the upper housing bout on the other side of the central axis 152. For example, it will be noted that the separation distance G between superimposed bouts is a range of 2 mm to 20 mm. With respect to the preferred 15½ inch viola, this length is approximately 5 mm.

In a general sense, the present invention can be described as a string instrument that is characterized by design features that relate to the size of the resonant chamber, the fingerboard length and the position of the fingerboard and strings with respect to the housing. This general description of the instrument can be summarized as:

a. A resonant chamber and housing defined by a back, curved sides having corresponding convex and concave configurations and a front, said housing having a central axis extending between an upper end of the housing to an opposing lower end;

b. A fingerboard and neck attached to the upper end of the housing and having a longitudinal central axis in a laterally offset position from the central axis of the housing;

c. A nut for supporting strings of the instrument above the fingerboard, said nut being coupled to a distal end of the fingerboard and neck; and d. A tail piece attached to a lower end of the housing in a comparable offset position with the offset position of the fingerboard and neck, the tail piece being configured for supporting lower ends of the strings.

Although the viola has been selected as the preferred embodiment of the invention in view of the convenience of simulating the dimensions of the violin in length, a reduction of corresponding dimension in the cello and bass may be applied, providing a reduction in size without the usual attendant loss of tone quality.

It is to be understood that the above-referenced arrangements are only illustrative of the application for the principles of the present invention. Numerous modifications and alternative arrangements can be devised without departing from the spirit and scope of the present invention. For example, stringed instruments may extend beyond orchestral strings, such as with the guitar family; however, the primary value of the present invention is with stringed instruments and particularly with the viola. Accordingly, while the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

We claim:

1. A string instrument, comprising:

a. A resonant chamber and housing configured as a viola and defined by a back, curved sides having corresponding convex and concave configurations and a front having a pair of f holes positioned on opposing sides of a bridge support location on the front, said housing having a sound peg disposed between the front and back and a central axis extending between the f holes from an upper end of the housing to an opposing lower end;

b. A fingerboard and neck attached to the upper end of the housing and having a longitudinal central axis in a laterally offset position from the central axis of the housing;

c. A nut for supporting strings of the instrument above the fingerboard, said nut being coupled to a distal end of the fingerboard and neck;

d. A tail piece attached to a lower end of the housing in a comparable offset position with the offset position of the fingerboard and neck, the tail piece being configured for supporting lower ends of the strings; and e. A scroll with string pegs laterally positioned in sides of the scroll for adjustably supporting upper ends of the strings, said scroll being attached to the nut in alignment with the fingerboard.

2. An instrument as defined in claim 1, wherein the string instrument has a body length of approximately 15½ inches.

3. An instrument as defined in claim 1, wherein a maximum length along a normal orientation from a center line along the fingerboard in a central, narrowest portion of the housing to one side of the instrument is approximately 71 mm to 86 mm and to an opposing side of the instrument is 63 mm to 71 mm.

4. An instrument as defined in claim 1, wherein a maximum length along a normal orientation from a center line along the fingerboard in a lower half of the housing to one side of the instrument is approximately 131 mm to 162 mm and to an opposing side of the instrument is 118 mm to 134 mm.

5. An instrument as defined in claim 1, wherein the neck and scroll have a cumulative length of 100 mm to 154 mm extending from the upper end of the housing to the nut.

6. An instrument as defined in claim 1, wherein the offset position is within a range of 3 mm to 20 mm.

7. An instrument as defined in claim 6, wherein the offset position is approximately 7 mm.

8. An instrument as defined in claim 1, wherein a maximum length along a normal orientation from a center line along the fingerboard in an upper half of the housing to one side of the instrument is approximately 106 mm to 130 mm and to an opposing side of the instrument is 94 mm to 102 mm.

9. An instrument as defined in claim 8, wherein the maximum length along the normal orientation from the center line along the fingerboard in the upper half of the housing to one side of the instrument is approximately 111 mm and to the opposing side of the instrument is 96 mm.

10. An instrument as defined in claim 8, wherein the maximum length along the normal orientation from the center line along the fingerboard in the central, narrowest portion of the housing to one side of the instrument is approximately 76 mm and to the opposing side of the instrument is 55 mm.

11. An instrument as defined in claim 8, wherein a maximum length along a normal orientation from a center line along the fingerboard in a lower half of the housing to one side of the instrument is approximately 137 mm and to an opposing side of the instrument is 123 mm.

12. An instrument as defined in claim 8, wherein the length extending from the upper end of the housing to the nut is approximately 131 mm.

13. An instrument as defined in claim 8, wherein the f holes include centrally located lateral notches and wherein a line connecting the notches between opposing f holes intercepts the central axis of the housing at approximately 216 mm from the upper end of the housing.

14. An instrument as defined in claim 1, wherein a comparative distance of the f hole on one side from the central axis is within a range of 0.5 to 5 mm compared to the distance to the f hole on the other side of the central axis.

15. An instrument as defined in claim 14, wherein the comparative distance is approximately 1 mm.

16. An instrument as defined in claim 1, wherein a vertical length along the neck from the front of the housing to an adjacent underside of the fingerboard is within a range of 3 mm to 14 mm.

17. An instrument as defined in claim 16, wherein the vertical length is approximately 9.5 mm.

18. An instrument as defined in claim 1, wherein a curved perimeter of the side of the upper housing on one side of the central axis differs in configuration with respect to a superimposed mirror image of the curved perimeter of the upper housing on the other side of the central axis differing only by a maximum length within a range of 2 mm to 20 mm.

19. An instrument as defined in claim 18, wherein the maximum length is approximately 5 mm.

* * * * *